US012768617B2

(12) United States Patent
Sánchez

(10) Patent No.: US 12,768,617 B2
(45) Date of Patent: Oct. 20, 2026

(54) RIFLE CASE CONVERTIBLE INTO A SHOOTING BENCH

(71) Applicant: Roberto Domínguez Sánchez, Chapinería (ES)

(72) Inventor: Roberto Domínguez Sánchez, Chapinería (ES)

( * ) Notice: Subject to any disclaimer, the term of this patent is extended or adjusted under 35 U.S.C. 154(b) by 0 days.

(21) Appl. No.: 19/048,019

(22) Filed: Feb. 7, 2025

(65) Prior Publication Data

US 2025/0251216 A1 Aug. 7, 2025

(30) Foreign Application Priority Data

Feb. 7, 2024 (ES) ..... ES202400030U

(51) Int. Cl.
*F41C 33/06* (2006.01)

(52) U.S. Cl.
CPC ..... *F41C 33/06* (2013.01)

(58) Field of Classification Search
CPC ..... F41C 33/06; F41A 23/16
USPC ..... 206/3, 317, 38, 45.2, 45.24, 579; 42/94
See application file for complete search history.

(56) References Cited

U.S. PATENT DOCUMENTS

| | | | | |
|---|---|---|---|---|
| 5,551,562 | A * | 9/1996 | Beretta | F41C 33/06 190/18 A |
| 5,850,796 | A * | 12/1998 | Cislo | F41C 33/06 109/51 |
| 2016/0363408 | A1* | 12/2016 | Reed | F41A 23/16 |
| 2022/0034627 | A1* | 2/2022 | Donovan | F41C 33/06 |
| 2023/0280138 | A1* | 9/2023 | Gleaton | F42B 39/26 206/3 |
| 2024/0035772 | A1* | 2/2024 | Odle | A47C 7/62 |
| 2024/0280346 | A1* | 8/2024 | Roberts | A45C 13/1084 |

FOREIGN PATENT DOCUMENTS

| | | |
|---|---|---|
| ES | 237286 U | 9/1978 |
| WO | 2011/068414 | 6/2011 |

* cited by examiner

*Primary Examiner* — Luan K Bui
(74) *Attorney, Agent, or Firm* — Bay State IP, LLC

(57) ABSTRACT

Rifle case convertible into a shooting bench, which, when the weapon is to be used, can be placed on the ground by deploying its supports to form a shooting bench on which to rest the rifle in order to aim with greater accuracy, consisting of a conventional rigid rifle case with two flaps joined on one side by a hinged system, which incorporates an articulated and extendable metal arm for the stock seat equipped with a recoil-absorbing bag, a rigid handle to manually support the rifle case and two equal, extendable, articulated metal arms for front support and balance.

1 Claim, 2 Drawing Sheets

RIFLE CASE CONVERTIBLE INTO A SHOOTING BENCH

CROSS REFERENCE TO RELATED APPLICATION

This application claims priority to and takes the benefit of Spanish Patent Application No. U202400030 filed on Feb. 7, 2024, the contents of which are herein incorporated by reference.

BACKGROUND OF THE INVENTION

Field of the Invention

The scope of the invention is the manufacture as an accessory for rifles of any use, such as sports, defence, etc.

Description of the Related Art

There are several devices for carrying elongated objects such as long-barrelled weapons, fishing rods, skateboards, snowboards, crossbows, etc.

For military purposes, a primary weapon, such as an automatic rifle is carried in the hands of soldiers, while a secondary weapon, usually a sniper rifle, is carried on the back by means of a carrying device.

For hunting purposes, there is often a need to carry a rifle over long distances and/or for long periods, over rough terrain, before the hunter reaches the target site.

Considering the state of the art in the matter, as far as inventions are concerned, the following documents have been indicated, identified by their publication number and title, respectively:

ES237286U, "Rigid and removable case for conditioning shotguns."

WO11068414, "Transport device for elongated objects."

On the other hand, one of the essential elements among practitioners of certain weapons sports is what is known as a shooting bench, a tool that facilitates the experience and makes it much more comfortable, since it serves to support the device in question when using it, supporting the weight of the weapon, avoiding vibrations and movements arising from the return after each shot.

Another consequence of using these tools is the savings in ammunition, since it also greatly improves aim.

Shooting practices such as skeet shooting or clay pigeon shooting have a large group of shooting bench consumers among their enthusiasts.

Regarding sport hunting, although it is a hobby that in many cases requires movement, there are many hunters who make static use of their artifacts, and when this is the case, it is most normal for them to have some product of this nature.

Thus, the aforementioned shooting benches are usually metal tripods that have one or two supports to hold only the barrel of the weapon, or also the stock, taking into account, depending on the intended use, that if it is going to be transported frequently it is preferable to look for lightness and moderate sizes.

No inventions or disclosures in the public domain have been identified where a combined solution with obvious advantages is provided where, in a single device, a rigid case can be used for storing and transporting the rifle, which in turn becomes a shooting bench when the user so requires.

Based on the background described, in which no public domain disclosures for such purposes are identified, the "Rifle case convertible into a shooting bench" provides, with respect to the state of the art, a rifle accessory for use as a conventional rigid case that additionally provides the following advantages:

- It provides a lightweight, transportable shooting bench that is easy to assemble and disassemble from its normal folded position for use as a hard case during the rifle's transport and storage.
- It allows aim to be improved during the rifle's use, without the weight of the rifle having to be supported with the body and without requiring any support or additional element.
- The recoil of the shot on the stock when firing is cushioned by the stock support itself, eliminating the impact on the shoulders and forearm of the rifle user, which is the cause of the usual injuries resulting from shooting practice.

SUMMARY OF THE INVENTION

The present invention relates to a rigid rifle case which, additionally, when the weapon is to be used, can be placed on the ground by deploying its supports to form a shooting bench on which to rest the rifle in order to aim with greater accuracy, without having to support the weight of the weapon.

By way of explanation of the invention, the "Rifle case convertible into a shooting bench" consists of a conventional rigid rifle case consisting of two covers joined on one of its sides by means of a hinged system that also incorporates the following elements described from the rifle butt in its shooting position on the shooting bench, towards the opposite end:

A. Articulated and extendable metal arm that emerges from the centre of one of the side covers of the case, from a folded position on the case to its alternative position on the shooting bench perpendicular thereto and such that its lower end rests on the surface of the ground by means of a manually adjustable height leg, while its upper perimeter has been configured to be the seat of the stock, including for this purpose a shock-absorbing bag where the recoil of the shot is projected.

B. Rigid handle to manually support the rifle case, provided at its top with a channel designed to support the rifle barrel, also provided with a pressure lever to facilitate barrel retention and manual release.

C. Two equal, extendable, articulated metal arms that emerge from the cover opposite the previous one along two rotation axes contained in the cover itself that divide it into approximately three equal parts, from a folded position towards the ends of the cover itself to an alternative position on a shooting bench forming an angle between 45° and 90° with respect thereto, such that its lower ends rest on the ground surface by means of the corresponding height-adjustable legs.

BRIEF DESCRIPTION OF THE DRAWINGS

To complement the description being made and in order to assist in a better understanding of the characteristics of the invention, in accordance with a preferred example of its practical implementation, a set of drawings is included as an integral part of said description, in which, for illustrative and non-limiting purposes, the following has been represented.

In the aforementioned figures, the following constituent elements can be highlighted:

1. Articulated and extendable metal arm for the stock seat.
2. Recoil cushioning bag.
3. Rifle barrel support channel.
4. Two extendable and equal articulated metal arms for front support and balance.
5. Height-adjustable legs.

DETAILED DESCRIPTION OF THE SEVERAL EMBODIMENTS

Figure 1:
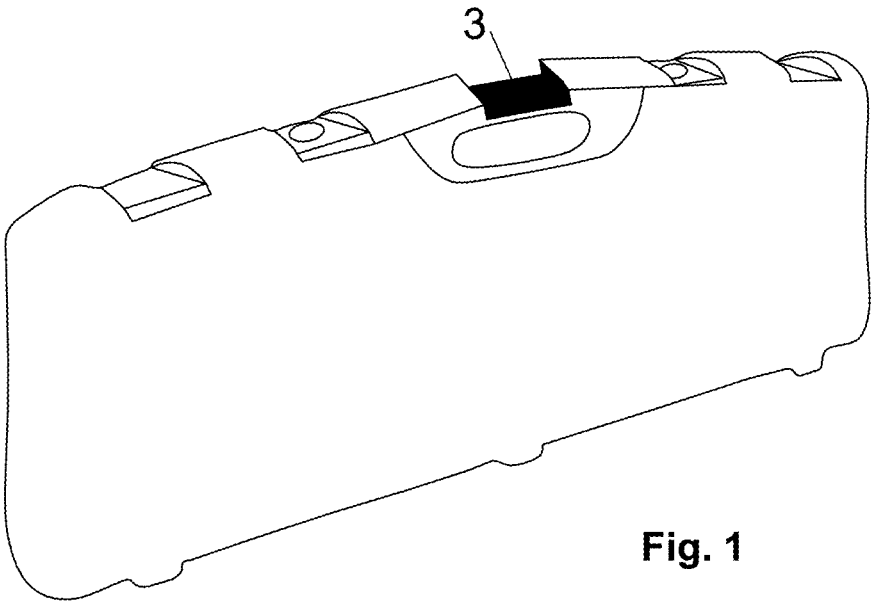
FIG. 1. Main perspective view of "Rifle case convertible into a shooting bench" in use as a conventional closed rigid case.

As a preferred embodiment of the "Rifle case convertible into a shooting bench" as shown in FIGS. 1-4, it can be conceived as a rigid case made of polypropylene as shown in FIG. 1, for conventional use as an accessory to facilitate the comfortable and safe storage and transport of a conventional rifle, with the particularity that its rigid handle for manually supporting the rifle case incorporates at its top a channel to support the rifle barrel (3) also provided with a pressure lever to facilitate the retention of the barrel and manual release.

Figure 2:
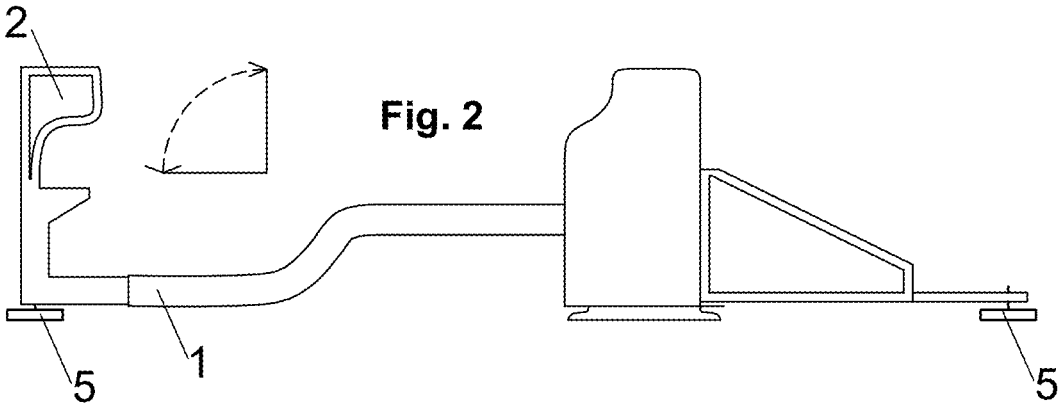
FIG. 2. Main elevation view of "Rifle case convertible into a shooting bench" in use as a shooting bench.
Figure 3:
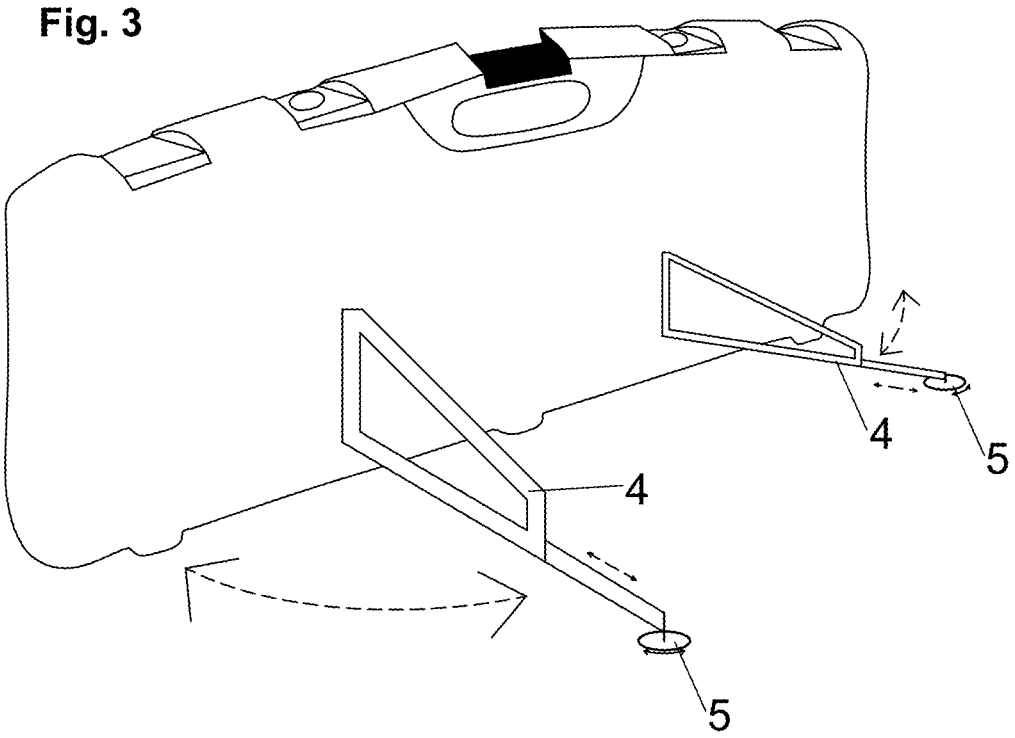
FIG. 3. Main perspective view of "Rifle case convertible into a shooting bench" in use as a shooting bench, to show the open position of the two articulated metal arms.
Figure 4:
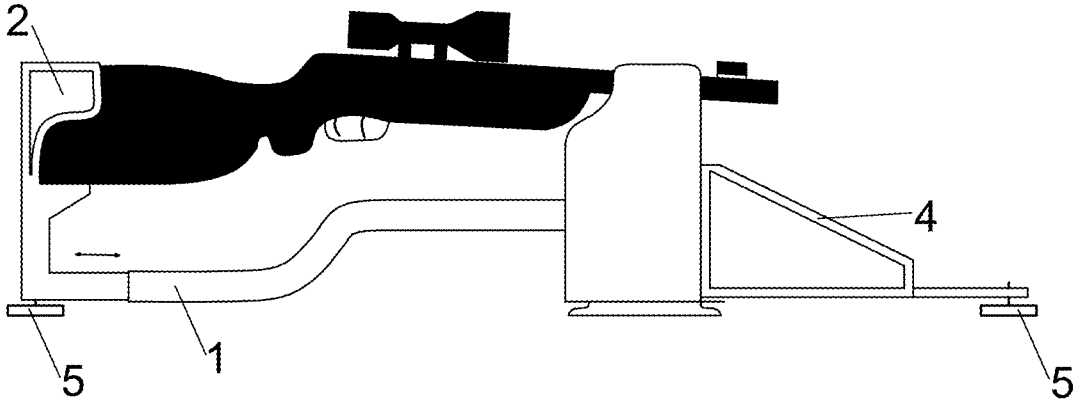
FIG. 4. Main elevation view of "Rifle case convertible into a shooting bench" in use as a shooting bench with the rifle in a shooting position.

However, once the user moves to the place where he wants to practice shooting, he can set up his shooting bench by carrying out the following sequence:

A. Opening the hard case, removing the rifle and all the items to be used during the shooting session.
B. Closing the case by engaging the safety levers and positioning it vertically on the ground with the orientation adapted to the direction in which the shooter will point.
C. Opening of the articulated and extendable metal arm of the stock seat (1) provided with a recoil-absorbing bag (2), from a folded position on the case to its alternative position on the shooting bench perpendicular thereto as shown in FIG. 2-4.
D. Opening of the two equal, extendable, articulated metal arms for front support and balance (4), from a folded position towards the ends of the case itself as shown in FIG. 3 to an alternative position on the shooting bench forming an angle between 45° and 90° with respect thereto.
E. Manual adjustment of the three support points on the ground, levelling the height-adjustable threaded legs (5).

Obviously, the regulation of the height-adjustable threaded legs (5) or the extendable nature of the three arms described (1-4) allow for a greater adaptation to the terrain on which the shooting bench rests. Likewise, to facilitate its transport and storage in rifle case mode, both covers, although not shown to facilitate visualisation, can contain on their surface the negative drawing of their corresponding arms (1-4), so that they remain collected against the case itself, without altering its enclosure.

At the end of shooting practice, the process is obviously reversed.

It is not considered necessary to extend this description in order for any expert in the field to understand the scope of the invention and the advantages derived therefrom in its different applications for sports, security or military purposes. Likewise, the materials used for the manufacture of the different elements described, dimensions, geometries, designs or technology present in the state of the art to adapt to the purposes described, will be susceptible to variation as long as this does not entail an alteration in the essence of the invention. The terms in which the specification has been described must be understood in a broad and non-limiting sense.

What is claimed is:

1. A rifle case convertible into a shooting bench, consisting of a rigid rifle case with two side covers joined on one side by a hinged system, characterized by incorporating the following elements described from a rifle stock in a shooting position on the shooting bench, towards the opposite end:

A) An articulated and extendable metal arm for a stock seat (1) equipped with a recoil-absorbing bag (2), which emerges from a center of a first side cover of the rifle case, from a folded position on the rifle case to an alternative position on the shooting bench perpendicular thereto and such that a lower end of the articulated and extendable metal arm for the stock seat (1) rests on the ground surface by means of a height-adjustable leg (5);
B) A rigid handle provided at a top of the rifle case to manually support the rifle case and a rifle barrel support channel (3) with a pressure lever to facilitate barrel retention and manual release; and
C) Two equal, extendable, articulated metal arms for front support and balance (4) that emerge from a second side cover opposite the first side cover along two rotation axes contained in the second side cover that divide the second side cover into approximately three equal parts, from a folded position towards ends of the second side cover to an alternative position on the shooting bench forming an angle between 45° and 90° with respect thereto, such that lower ends of the two equal, extendable, articulated metal arms for front support and balance (4) rest on the ground surface by means of the corresponding height-adjustable legs (5).

* * * * *